United States Patent [19]

Furukawa et al.

[11] Patent Number: 4,469,540

[45] Date of Patent: Sep. 4, 1984

[54] PROCESS FOR PRODUCING A HIGHLY BULKY NONWOVEN FABRIC

[75] Inventors: Yasuhiko Furukawa; Hiromu Sonoda; Taizo Sugihara, all of Shigaken, Japan

[73] Assignee: Chisso Corporation, Osaka, Japan

[21] Appl. No.: 402,275

[22] Filed: Jul. 27, 1982

[30] Foreign Application Priority Data

Jul. 31, 1981 [JP] Japan ..... 56-120513

[51] Int. Cl.[3] ..... B29J 5/00

[52] U.S. Cl. ..... 156/62.4; 156/181; 264/171; 264/324

[58] Field of Search ..... 264/171, 324, 248; 156/167, 181, 62–64

[56] References Cited

U.S. PATENT DOCUMENTS

| | | | |
|---|---|---|---|
| 3,533,904 | 10/1970 | Jurkiowitsch | 428/397 |
| 3,589,956 | 6/1971 | Kranz | 428/397 |
| 3,595,731 | 7/1971 | Davies | 428/397 |
| 4,115,620 | 9/1978 | Gupta et al. | 428/374 |
| 4,211,819 | 7/1980 | Kunimune et al. | 428/373 |
| 4,234,655 | 11/1980 | Kunimune et al. | 428/374 |
| 4,269,888 | 5/1981 | Ejima | 428/397 |
| 4,315,881 | 2/1982 | Nakajima et al. | 264/210.8 |
| 4,323,626 | 4/1982 | Kunimune et al. | 428/373 |

*Primary Examiner*—Jay H. Woo

*Attorney, Agent, or Firm*—Fred Philpitt

[57] ABSTRACT

A process for producing a highly bulky nonwoven fabric is provided, which process comprises melt-spinning a crystalline propylene polymer as a first component and an ethylene polymer as a second component, into side-by-side or sheath-core type composite fibers so that the first component after melt-spinning can have a specified $M_w/M_n$ value; collecting the fibers into a continuous tow form; stretching the tow in a specified stretch ratio; cooling the stretched tow to a specified temperature and then drawing it by a pair of nip rolls, one or both of which are of a non-metal, to obtain heat-adhesive composite fibers having apparent crimps of a specified number, a specified percentage crimp modulus and substantially no latent crimpability; and heat-treating a web consisting of the fibers alone or a blend thereof with other fibers at a specified temperature.

1 Claim, No Drawings

PROCESS FOR PRODUCING A HIGHLY BULKY NONWOVEN FABRIC

BACKGROUND OF THE INVENTION

1. Field of the Invention

This invention relates to a process for producing a highly bulky nonwoven fabric by the use of heat-adhesive composite fibers having three-dimensional apparent crimps and substantially no latent crimpability.

2. Description of the Prior Art

Porous nonwoven fabrics obtained by using heat-adhesive composite fibers whose composite components are fiber-forming polymers of different melting points have been known (Japanese patent publication Nos. Sho 42-21318/1967, Sho 44-22547/1969, Sho 52-12830/1977, etc.). Crimps which are developed when composite fibers are stretched and then relaxed (such crimps will hereinafter be often referred to as apparent crimps), are spiral, three-dimensional crimps. Apparent crimps are known to impart bulkiness to the fibers, and have been utilized in the fields of wadding for counterpane, etc.

However, heat-adhesive composite fibers consisting of polymer components of different melting points and having apparent crimps have drawbacks. For example when the fibers are subjected to heat treatment for heat-adhesion, additional crimps generally develop (such crimps being brought about by "latent crimpability" of the fibers), resulting in a large shrinkage of the fibers; hence homogeneous nonwoven fabric cannot be obtained and the bulk of the resulting web is reduced as compared with that prior to heat treatment.

To avoide such a shrinkage due to latent crimpability generated at the time of heat treatment when making a nonwoven fabric from such fibers, a process has been proposed wherein composite fibers are annealed in advance of making a nonwoven fabric from the fibers to thereby make the latent crimp-ability apparent in advance. According to the process, however, it is difficult to control the number of crimps. If the number of crimps becomes too large, interfilamentary entanglements become too firm at the time of web formation and reduce the bulk of the web. To the contrary, if the number of crimps is too small, an obstacle occurs at the time of processing the fibers into a web in that interfilamentary entanglements are insufficient and thereby reduce the bulk of the web.

Thus it is the present status that porous nonwoven fabrics comprising heat-adhesive composite fibers according to the prior art have not been used for substantial application in fields needing bulkiness, such as wadding for kilts.

The present inventors have made strenuous studies for obtaining a highly bulky nonwoven fabric without the above-mentioned drawbacks and as a result have attained the present invention.

SUMMARY OF THE INVENTION

The present invention resides in a process for producing a highly bulky nonwoven fabric which comprises:

melt-extruding a first component consisting of a crystalline propylene polymer and also a second component consisting of an ethylene polymer into composite fibers of side-by-side or sheath-core type so that the second component can occupy at least a portion of the fiber surface continuously in the lengthwise direction of the fibers and the Q value of the first component after melt-spinning ($Q=M_w/M_n$; $M_w$ and $M_n$ represent a weight average molecular weight and a number average molecular weight, respectively) being 3.5 or greater to prepare unstretched fibers;

collecting the unstretched fibers into the form of a continuous tow;

preheating the resultant tow to a temperature of 80° C. or higher but lower than the melting point of the second component in advance of stretching;

successively stretching the tow in a stretch ratio of three times or more the original length thereof, in which ratio neither of the composite components break;

cooling the resulting stretched tow down to a temperature below the preheating temperature, at and after the point where the stretching has been finished;

cooling the stretched tow down to 50° C. or lower and then drawing it by means of a pair of nip rolls, at least one of which is of a non-metal, to obtain heat-adhesive composite fibers having apparent crimps, the number of which is 4 to 12 per inch and the percentage crimp modulus of which is 75% or higher, and having substantially no latent crimpability; and subjecting a web consisting only of the heat-adhesive composite fibers or containing at least 20% by weight of the heat-adhesive composite fibers, to heat treatment at a temperature equal to or higher than the melting point of the second component of the composite fibers, but lower than the melting point of the first component thereof, to obtain a highly bulky nonwoven fabric which is stabilized in structure mainly by the melt-adhesion of the second component of the heat-adhesive composite fibers.

DETAILED DESCRIPTION OF THE PREFERRED EMBODIMENTS

The crystalline propylene polymer used as the first component in the present invention comprises crystalline polymers composed mainly of propylene and includes not only propylene homopolymer but copolymers of propylene, as a main component, with ethylene, butene-1, 4-methylpentene-1 or the like. Further, the ethylene polymer used as the second component comprises polymers composed mainly of ethylene such as high pressure process polyethylene or medium or low pressure process polyethylene, and includes not only ethylene homopolymers, but copolymers of ethylene, as a main component, with propylene, butene-1, vinyl acetate or the like (EVA in the case of vinyl acetate). The melting points of these ethylene polymers are preferably lower than those of the first component crystalline propylene polymers, by 20° C. or more. It is possible to add to these crystalline propylene polymers and ethylene polymers, various additives such as stabilizers, fillers, pigments, etc. usually employed for polyolefin fibers, in the range of amounts which do not harm the object of the present invention.

It is necessary for the heat-adhesive composite fibers used in the present invention that the second component occupy at least a portion of the fiber surface continuously in the lengthwise direction of the fibers. It is preferable that the second component coat the fiber surface as broadly as possible. Such composite fibers can be obtained according to known melt-spinning process for side-by-side type composite fibers or sheath-core type composite fibers wherein the sheath portion is of the second component. Although the composite proportion of the two components has no particular limitation, the proportion of the second component is preferably 40 to 70% by weight of the composite fibers.

The heat-adhesive composite fibers used in the present invention must be spun so that the Q value of the first component after spinning can be 3.5 or more, preferably 4 or more. The Q value is the ratio of the weight average molecular weight ($M_w$) to the number average molecular weight ($M_n$), both measured according to gel permeation chromatography, i.e. $M_w/M_n$. It is known that crystalline propylene polymers are deteriorated due to the effects of heat and shear upon the polymers at the time of melt-spinning to reduce the $M_w$ value, and as a result, the Q value after spinning is less than that before spinning. If the Q value of the propylene polymers is less than 3.5, the molecular weight distribution is narrowed in the width, and composite fibers obtained under such spinning conditions have a reduced percentage elastic shrinkage, and a reduced apparent crimps-developing capability, resulting in 4 crimps or less per inch; hence it is impossible to satisfactorily pass through the carding step most generally employed for web formation for making a nonwoven fabric from the fibers. Furthermore, the bulkiness of the resulting web is not only inferior, but since the latent crimpability of the composite fibers becomes greater, the web shrinks during manufacture of a nonwoven fabric from the fibers to make it impossible to obtain a homogeneous and highly bulky nonwoven fabric.

The Q value of the first component after composite spinning can be known by measuring the Q value of fibers obtained by subjecting the first component alone to single spinning under the same conditions as those of the component at the time of composite spinning. By carrying out such a single spinning, it is possible to determine the first component to be used as the raw material for the composite fibers and establish the spinning conditions for the composite spinning.

Ethylene polymers generally have a small thermal deterioration at the time of melt-spinning and the melt-spinning has only a small effect upon the number of apparent crimps and the percentage crimp modulus of composite fibers due to the differences in the spinning conditions or the melt index of ethylene polymers as the raw material; hence no particular limitation is required for the ethylene polymers as the second component of the heat-adhesive composite fibers used in the present invention. Ethylene polymers having a melt index of about 5 to 35 are preferably used due to the easiness of spinning.

As to the unstretched composite fibers consisting of the first and second components, it is necessary to collect the fibers into a tow; to then preheat this tow to a temperature of 80° C. or higher but lower than the melting point of the second component in advance of stretching; to successively stretch the tow in a stretch ratio of three times or more the original length thereof, in which ratio neither of the composite components break; and to cool the resulting stretched tow down to a temperature below the preheating temperature, at and after the point where the stretching has been finished. If the preheating temperature is lower than 80° C., breakage of the fibers is liable to occur, and even if it does not occur, the apparent crimps and latent crimpability of the resulting fibers will increase.

Further, if the web is heated to a temperature equal to or higher than the melting point of the second component, interfilamentary heat-adhesion occurs; hence such heating is undesirable. If the stretch ratio is lower than 3.0 times, the difference in the elastic shrinkage between the two composite components is so small that the development of the apparent crimps becomes smaller and the latent crimpability becomes greater; further, if the stretching is carried out to an extent to which either one of the composite components breaks, strain based on the difference in the elastic shrinkage between the two components is not generated, wherein this is no development of the apparent crimps; hence both the above cases are undesirable. It is possible to carry out the stretching at a plurality of steps where the stretching is divided into two or more stretchings or a single step stretching where a definite stretch ratio is attained.

The preheating operation carried out in advance of the stretching may be conducted at a part of a stretching machine where the tow is introduced thereinto, by known means such as hot water bath, heating oven-heated by not air, stream or infrared ray. The unstretched fibers are preheated to a definite temperature, stretched in a definite stretch ratio and cooled down to a temperature below the preheating temperature. The resulting stretched tow still remains under tension, because if the stretched tow remains at a temperature equal to or higher than the preheating temperature, the difference in the elastic shrinkage between the two composite components is reduced and inhibits the development of apparent crimps.

Next, the stretched tow is drawn in a state where it has been cooled down to 50° C. or lower. The tow is drawn by means of a pair of nip rolls at least one of which is of a non-metal. In the case where the stretched tow is drawn under a nip pressure sufficient to draw the tow under tension, and the draw rolls are both metal, the stretched tow which has passed through the draw rolls and is in a relaxed state has insufficiently developed apparent crimps. If the temperature of the stretched tow exceeds 50° C., insufficient apparent crimps develop even if either one or both of the draw rolls are of a non-metal. In the case where at least one of the draw rolls is a non-metallic roll such as rubber roll, cotton roll, etc. and the temperature of the stretched tow is 50° C. or lower, the resulting composite fibers have three-dimensional apparent crimps the number of which is 4 to 12 per inch and a percentage crimp modulus of 75% or higher, and the latent crimpability is extremely small, sometimes negative and substantially nill.

If the number of crimps of the composite fibers used in the present invention is less than 4 per inch, interfilamentary entanglements are insufficient and make it difficult to prepare a web from the composite fibers alone. Even if a web can be prepared by blending the composite fibers with other fibers, this results in uneven basis weight and uneven density in the web; hence such a small number of crimps is undesirable. The steric crimps developed in the composite fibers impart a greater bulkiness to the web than that imparted mechanically. If the number of crimps exceeds 12 per inch, interfilamentary entanglements are so dense that there is such an undesirable tendency for neps to occur at the time of web formation or that shrinkage occurs after web formation to make the web density higher. When the number of crimps is in the range of 6 to 8 per inch, the most bulky web is obtained.

The reason that the percentage crimp modulus is limited to 75% or higher is that nonwoven fabrics prepared using conventional heat-adhesive composite fibers, even in the case of those called porous and bulky, have usually been accompanied by a reduction in the bulk of web in a proportion of 30% or higher based on the bulk of web prior to heat treatment, when the composite fibers are subjected to heat treatment to prepare a nonwoven fabric therefrom. Whereas if heat-adhesive composite fibers having a percentage crimp modulus of 75% or higher, it is possible to make the percentage reduction of the bulk lower than 30%, and also, due to good crimps-retainability, it is possible to obtain a more bulky nonwoven fabric.

Fibers of other kinds in the case where they are blended with the composite fibers in the present invention are required not to melt even when the web of the blend is subjected to heat treatment; hence fibers of any kind may be used as long as they have a melting point higher than the temperature of the heat treatment and are not deteriorated by the heat treatment (e.g. carbonization). One kind or more adequately chosen from among fibers, for example, natural fibers, such as cotton or wool, semisynthetic fibers such as viscose rayon, cellulose acetate fibers, synthetic fibers such as polyolefin fibers, polyamide fibers, polyester fibers, acrylonitrile fibers, acrylic fibers, polyvinyl alcohol fibers, and further mineral fibers such as glass fibers or asbestos, can be used. The proportion of such fibers blended with the composite fibers is 80% or less based on the total amount of such fibers and the composite fibers. If the composite fibers used in the present invention are contained in the fiber blend in a proportion of about 20%, a certain extent of adhesion effectiveness is brought about to exhibit the effectiveness of the present invention. For example, such a fiber blend can be well used for the application fields such as sound-absorbing material, sound-insulating material, etc. However, for application fields where strength is needed, the content of the composite fibers is necessary to be about 30%, and if the content is 30% or higher, the effectiveness of the present invention is notably exhibited. As to the blending manner of the composite fibers with other fibers, an optional manner may be employed such as a manner wherein these fibers are blended in the form of short fibers, a manner wherein these fibers are blended in the form of tow, etc.

The composite fibers alone or a blend thereof with other fibers can be made into a suitable form such as a parallel web, cross web, random web, tow web, etc. according to purposes, to obtain a nonwoven fabric.

For the heat treatment carried out for the purpose of making a nonwoven fabric from such a web, a heating medium of either hot air or steam may be employed. The low melting point component of the composite fibers is brought into molten state by the heat treatment, and when the thus molten low melting point component (i.e. the second component) of one of the composite fibers come in contact with the low melting point component or the high melting point component of the composite fibers adjacent to the molten component, especially with the low melting point component, tight melt-adhesion is formed therebetween. The composite fibers, even when subjected to the heat treatment, are almost unchanged in the number of crimps; thus the structural stabilization of the resulting nonwoven fabric is scarcely due to entanglements of fibers and mainly due to the above-mentioned melt-adhesion.

The present invention will be concretely described below by way of Examples and Comparative examples, and in advance of this descriptin, the methods of measuring various characteristic properties referred to therein are shown below.

Melt flow rate (MFR): according to the conditions of ASTM D1238 (L)

Melt index (MI): according to the conditions of ASTM D1238 (E)

Number of apparent crimps: according to the method of measuring the number of crimps, recited in JIS L1074

Number of crimps after heat treatment: stretched yarns of about 20 cm long are subjected to heat treatment in a relaxed state under the same conditions as those at the time of heat treatment for making a nonwoven fabric from fibers, followed by measuring the number of crimps.

Percentage crimp modulus: according to the method of measuring the percentage crimp modulus, recited in JIS L1074

Percentage heat shrinkage of web: a web of 25 cm×25 cm carded in parallel was subjected to heat treatment in a relaxed state under the same conditions as in the case of the heat treatment for making a nonwoven fabric from fibers, and thereafter the length (a cm) of the resulting nonwoven fabric in the direction of fiber arrangement was measured, followed by calculation of the percentage heat shrinkage of web according to the following equation: percentage heat shrinkage of web $=(1-a/25)\times 100$.

Bulkiness: about 200 g of sheets of a web or nonwoven fabric (25 cm×25 cm) were taken and correctly weighted (weight: Wg), followed by placing them on one another, placing thereon one sheet of a cardboard (area: 25 cm×25 cm, weight: 28 g), measuring the total height (h cm), calculating the volume (V $cm^3$) of the web or nonwoven fabric and calculating the bulkiness according to the following equation: bulkiness $(H)=V/W=625\times h/W$ ($cm^3/g$).

Percentage bulk reduction: calculated from the bulkiness of web ($H_o$) and that of nonwoven fabric ($H_f$) according to the following equation:

Percentage bulk reduction $=(1-H_f/H_o)\times 100$.

EXAMPLES 1 TO 8 AND COMPARATIVE EXAMPLES 1 TO 7

Composite fibers were obtained by combining various kinds of propylene polymers (first component) with various kinds of ethylene polymers. The characteristic properties of these raw material resins, spinning conditions, stretching conditions and drawing conditions are shown in Table 1 in contrast to the limiting conditions of the present invention. As to the spinning nozzles, those having a hole diameter of 1.0 mm and a number of holes of 60 were employed in the case where the fineness of unstretched fibers was 72 deniers, while those having a hole diameter of 0.5 mm and a number of holes of 120 were employed in the case where the fineness of unstretched fibers was 24 deniers or less. In any of the sheath-core type composite fibers, the sheath is of the second component and the core is of the first component.

For preheating the unstretched tow at the time of stretching, heated rolls of the electrical heating type were used. Any of the resulting stretched tows were cut to a fiber length of 64 mm to make short composite fibers. The short composite fibers, alone or blended with other fibers, were passed through a 40" roller card to make a card web having a basis weight of about 300 $g/m^2$, which web was then converted to a nonwoven fabric by means of a dryer of hot air-circulation type.

The characteristic properties of the composite fibers obtained in the Examples and Comparative examples, the kinds and characteristic properties of other fibers blended, the conditions of heat treatment under which a nonwoven fabric was made from these fibers and the characteristic properties of the resulting nonwoven fabrics are shown in Table 2.

As is apparent from Table 1 and Table 2, any of the webs obtained based on the constitution of the present invention had a lower percentage bulk reduction at the time of heat treatment for making a nonwoven fabric from the fibers to give a nonwoven fabric having a superior bulkiness.

TABLE 1

| | First component | | | | Spinning Conditions | | | | |
|---|---|---|---|---|---|---|---|---|---|
| | Resin | Q value | | | | Composite | Spinning temperature | | |
| Limiting conditions | (MFR) Propylene polymer | Before spinning — | After spinning ≧3.5 | Second component Resin (MI) Ethylene polymer | Composite form Second component, continued on the fiber surface | ratio (1st/2nd) % — | 1st/2nd, °C. — | spinning nozzle | Fineness d — |
| Example 1 | PP (4.5) | 4.3 | 3.6 | HDPE (20) | Side-by-side type | 50/50 | 300/200 | 270 | 24 |
| Comparative example 1 | PP (4.5) | 4.3 | 3.3 | HDPE (20) | Side-by-side type | 50/50 | 300/200 | 270 | 24 |
| Example 2 | PP (8.4) | 6.0 | 4.3 | HDPE (20) | Side-by-side type | 50/50 | 300/200 | 270 | 24 |
| Comparative example 2 | PP (8.4) | 6.0 | 4.3 | HDPE (20) | Side-by-side type | 50/50 | 300/200 | 270 | 24 |
| Comparative example 3 | PP (8.4) | 6.0 | 4.3 | HDPE (20) | Side-by-side type | 50/50 | 300/200 | 270 | 24 |
| Example 3 | PP (8.4) | 6.0 | 4.3 | HDPE (20) | Side-by-side type | 50/50 | 300/200 | 270 | 16 |
| Comparative example 4 | PP (8.4) | 6.0 | 4.3 | HDPE (20) | Side-by-side type | 50/50 | 300/200 | 270 | 16 |
| Comparative example 5 | PP (8.4) | 6.0 | 4.3 | HDPE (20) | Side-by-side type | 50/50 | 300/200 | 270 | 16 |
| Example 4 | PP (7.0) | 5.8 | 4.7 | HDPE/LDPE*3 | Sheath-core type | 60/40 | 280/240 | 270 | 72 |
| Comparative example 6 | PP (7.0) | 5.8 | 4.7 | HDPE/LDPE*3 | Sheath-core type | 60/40 | 280/240 | 270 | 72 |
| Comparative example 7 | PP (7.0) | 5.8 | 4.7 | HDPE/LDPE*3 | Sheath-core type | 60/40 | 280/240 | 270 | 72 |
| Example 5 | PP (7.0) | 5.8 | 4.7 | HDPE/LDPE*3 | Sheath-core type | 60/40 | 280/240 | 270 | 72 |
| Example 6 | PP*1 (7.0) | 5.8 | 4.7 | HDPE*4 (22) | Side-by-side type | 40/60 | 300/180 270 | 72 | |
| Example 7 | PP*2 (7.0) | 5.8 | 4.7 | HDPE*5 (22) | Side-by-side type | 50/50 | 280/180 | 265 | 72 |
| Example 8 | PP (7.0) | 5.8 | 4.7 | EVA*6 (10) | Sheath-core type | 50/50 | 280/180 | 265 | 12 |

| | Stretching conditions | | | Drawing conditions | |
|---|---|---|---|---|---|
| Limiting conditions | Preheating temperature °C. ≧80° C. | Tow temperature at stretching-finish point °C. Preheating temperature or lower | Stretch ratio ≧3.0 | Tow temp. at the time of draw °C. ≦50° C. | Material of rolls One roll is of non-metal |
| Example 1 | 90 | Room temp. | 4.0 | Room temp. | Metal/rubber |
| Compar. ex. 1 | 90 | Room temp. | 4.0 | Room temp. | Metal/rubber |
| Example 2 | 83 | Room temp. | 3.2 | Room temp. | Metal/rubber |
| Compar. ex. 2 | 78 | Room temp. | 3.2 | Room temp. | Metal/rubber |
| Compar. ex. 3 | 83 | Room temp. | 2.8 | Room temp. | Metal/rubber |
| Example 3 | 105 | 100 | 4.0 | 47 | Metal/rubber |
| Compar. ex. 4 | 105 | 110 | 4.0 | 45 | Metal/rubber |
| Compar. ex. 5 | 105 | 100 | 4.0 | 52 | Metal/rubber |
| Example 4 | 85 | Room temp. | 3.6 | Room temp. | Metal/rubber |
| Compar. ex. 6 | 85 | Room temp. | 4.0 | Room temp. | Metal/rubber |
| Compar. ex. 7 | 85 | Room temp. | 3.6 | Room temp. | Metal/Metal |
| Example 5 | 85 | Room temp. | 3.6 | Room temp. | Rubber/rubber |
| Example 6 | 85 | Room temp. | 4.5 | Room temp. | Metal/rubber |
| Example 7 | 85 | Room temp. | 4.5 | Room temp. | Metal/cotton |
| Example 8 | 80 | Room temp. | 3.5 | Room temp. | Rubber |

TABLE 1-continued

| | | | | | | | | | | | |
|---|---|---|---|---|---|---|---|---|---|---|---|
| | | | | | | | | | | | rubber |

PP: polypropylene,
HDPE: high density polyethylene
LDPE: low density polyethylene,
EVA: ethylene-vinyl acetate copolymer
*1: contains 3% of carbon black,
*2: contains 5% of halogenated fire-retardant,
*3: blend of 50%/50%, both, MI 5.0
*4: contains 3% of carbon black,
*5: contains 5% of halogenated fire-retardant,
*6: vinyl acetate content, 5%

TABLE 2

| | | | | Characteristic properties of composite fibers | | Conditions of making nonwoven fabric from fibers | | | | |
|---|---|---|---|---|---|---|---|---|---|---|
| | | Number of crimps (per inch) | | | | | | | | |
| Limiting conditions — | Fineness d — | Apparent 4~12 | After heat treatment — | Percentage crimp modulus % ≧75 | Card-passing properties — | Fineness × length, d × mm, — | blend ratio % (≧20) | Other fibers, — | Fineness × length, d × mm, — | blend ratio % (≧80) |
| Ex. 1 | 6.0 | 4.5 | 5.1 | 78 | good | 6 × 64 | 100 | | | |
| Compar. ex. 1 | 6.0 | 2.3*1 | 2.9 | 66 | bad | 6 × 64 | 100 | | | |
| Ex. 2 | 7.5 | 5.4 | 5.7 | 84 | good | 7.5 × 64 | 23 | PET*3 | 6 × 64 | 77 |
| Compar. ex. 2 | 7.5 | 13.0 | 25.8 | 82 | Unevenness of basis weight, large | 7.5 × 65 | 23 | PET | 6 × 64 | 77 |
| Compar. ex. 3 | 8.6 | 4.3 | 15.6 | 73 | good | 7.5 × 65 | 23 | PET | 6 × 64 | 77 |
| Ex. 3 | 4.0 | 7.5 | 6.8 | 88 | good | 4 × 64 | 100 | | | |
| Compar. ex. 4 | 4.0 | 2.0*1 | 2.0 | 82 | bad | 4 × 64 | 100 | | | |
| Compar. ex. 5 | 4.0 | 3.3*1 | 3.1 | 80 | bad | 4 × 64 | 100 | | | |
| Ex. 4 | 20.0 | 7.4 | 7.7 | 85 | good | 20 × 64 | 50 | PP*3 | 18 × 64 | 50 |
| Compar. ex. 6 | 18.0 | 0*2 | 0 | — | bad | 18 × 64 | 50 | PP | 18 × 64 | 50 |
| Compar. ex. 7 | 20.0 | 2.6*1 | 3.1 | 83 | bad | 20 × 64 | 50 | PP | 18 × 64 | 50 |
| Ex. 5 | 18.0 | 11.2 | 10.0 | 83 | good | 18 × 64 | 100 | | | |
| Ex. 6 | 16.0 | 8.1 | 6.5 | 81 | good | 16 × 64 | 100 | | | |
| Ex. 7 | 16.0 | 8.4 | 7.7 | 84 | good | 16 × 64 | 100 | | | |
| Ex. 8 | 3.4 | 6.6 | 6.5 | 80 | good | 3.4 × 64 | 100 | | | |

| | Conditions of making nonwoven fabrics from fibers | | Characteristic properties of nonwoven fabric | | | |
|---|---|---|---|---|---|---|
| | | | Bulkiness | | | |
| Limiting conditions — | Heat treatment conditions °C. × min. — | Basis weight of nonwoven fabric g/m² — | Web cm³/g — | Nonwoven fabric cm³/g — | Percentage bulk reduction % — | Percentage heat shrinkage % — |
| Ex. 1 | 145 × 5 | 280 | 147 | 106 | 28 | 2 |
| Compar. ex. 1 | 145 × 5 | 293 | 122 | 70 | 43 | 2 |
| Ex. 2 | 145 × 5 | 297 | 159 | 137 | 14 | 3 |
| Compar. ex. 2 | 145 × 5 | 303 | 140 | 92 | 34 | 13 |
| Compar. ex. 3 | 145 × 5 | 305 | 146 | 92 | 37 | 14 |
| Ex. 3 | 145 × 5 | 295 | 169 | 152 | 10 | 0 |
| Compar. ex. 4 | 145 × 5 | 290 | 133 | 93 | 30 | 0 |
| Compar. ex. 5 | 145 × 5 | 300 | 137 | 95 | 31 | 0 |
| Ex. 4 | 145 × 5 | 265 | 150 | 132 | 12 | 7 |
| Compar. ex. 6 | 145 × 5 | 283 | 124 | 66 | 47 | 6 |
| Compar. ex. 7 | 145 × 5 | 277 | 130 | 85 | 35 | 8 |
| Ex. 5 | 145 × 5 | 307 | 152 | 132 | 13 | 0 |
| Ex. 6 | 145 × 5 | 300 | 157 | 122 | 22 | 0 |
| Ex. 7 | 145 × 5 | 315 | 173 | 159 | 8 | +1 |
| Ex. 8 | 130 × 5 | 294 | 160 | 150 | 6 | 0 |

*1: As to composite fibers which were insufficient in the number of crimps and bad in the card-passing properties, mechanical crimps (7 to 9 crimps/inch) were imparted thereto.
*2: Breakage of single filament occurred.
*3: PET (polyester), PP (polypropylene)

What is claimed is:

1. A process for producing a highly bulky nonwoven fabric which comprises:

(a) melt-spinning a first component consisting of a crystalline propylene polymer and a second component consisting of an ethylene polymer into composite fibers having a side-by-side or sheath-core configuration so that the second component can occupy at least a portion of the fiber surface continuously in the lengthwise direction of the fibers, the Q value, ratio of the weight average molecular weight to the number average molecular weight of said first component after melt-spinning being 3.5 or greater, to prepare unstretched fibers;

(b) collecting said unstretched fibers into the form of a continuous tow;

(c) preheating the resultant tow to a temperature of 80° C. or higher but lower than the melting point of said second component in advance of stretching, (d) successively stretching said tow in a stretch ratio of three times or more the original length thereof, in which ratio neither of said composite components break;

(e) cooling the resulting stretched tow down to a temperature below the preheating temperature, at and after the point where the stretching has been finished, (f) cooling the stretched tow down to 50° C. or lower and then drawing it by means of a pair of nip rolls, at least one of which is of a non-metal, to obtain heat-adhesive composite fibers having apparent crimps, the number of which is 4 to 12 per inch and the percentage crimp modulus of which is 75% or higher, and having substantially no latent crimpability; and (g) subjecting a web consisting only of said heat-adhesive composite fibers or containing at least 20% by weight of said heat-adhesive composite fibers to heat treatment at a temperature equal to or higher than the melting point of said second component of the composite fibers, but lower than the melting point of said first component thereof, to obtain a highly bulky nonwoven fabric stabilized in structure mainly by the melt-adhesion of the second component of said heat-adhesive composite fibers.

* * * * *